US007892025B2

(12) United States Patent
Daily et al.

(10) Patent No.: US 7,892,025 B2
(45) Date of Patent: Feb. 22, 2011

(54) SEALED CONNECTOR ASSEMBLY

(75) Inventors: Christopher George Daily, Harrisburg, PA (US); Matthew E. Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 23 days.

(21) Appl. No.: 12/175,614

(22) Filed: Jul. 18, 2008

(65) Prior Publication Data

US 2010/0015826 A1 Jan. 21, 2010

(51) Int. Cl.
*H01R 13/58* (2006.01)

(52) U.S. Cl. ..... 439/606

(58) Field of Classification Search ..... 439/606, 439/604, 147, 405, 497, 492, 637, 660, 357, 439/347

See application file for complete search history.

(56) References Cited

U.S. PATENT DOCUMENTS 4,762,500 A * 8/1988 Dola et al. ..... 439/79
4,780,095 A * 10/1988 Classon et al. ..... 439/637
4,824,394 A * 4/1989 Roath et al. ..... 439/395
4,871,318 A * 10/1989 Gobets et al. ..... 439/76.1
5,125,850 A 6/1992 Locati
5,470,238 A * 11/1995 Walden ..... 439/98
5,533,908 A 7/1996 Henry et al.
5,726,513 A 3/1998 Lyle et al.
5,762,908 A 6/1998 Schiestl
6,036,531 A 3/2000 Lee et al.
6,193,541 B1 2/2001 Lee
6,203,359 B1 3/2001 Lee
6,280,277 B1 * 8/2001 Greenberg et al. ..... 446/161
D455,127 S * 4/2002 Wu ..... D13/147
6,705,886 B1 3/2004 Brown
6,767,252 B2 * 7/2004 McGrath et al. ..... 439/637
6,811,424 B2 11/2004 Seminara et al.
6,817,887 B2 11/2004 Jones et al.
6,893,277 B2 5/2005 Parrish et al.
6,945,801 B2 9/2005 Brown (Continued)

FOREIGN PATENT DOCUMENTS

DE 100 45 839 A 1 3/2002

*Primary Examiner*—Alexander Gilman

(57) ABSTRACT

A sealed connector system and components thereof is disclosed. The sealed connector system has a sealed cable assembly and a printed circuit board header assembly. The sealed cable assembly has a cable housing and a cable terminated thereto. A cover, as described above, is overmolded over a portion of the cable housing and a portion of the cable. The cover is one continuous member that acts as a seal to prevent contaminants from entering the cable housing. A printed circuit board header assembly is mated to the cable housing. The header assembly has recesses provided proximate a circuit board mounting surface, with the recesses being configured to provide additional space on a circuit board on which the header assembly is mounted. Legs or ribs may be provided proximate the ends of the circuit board contact area. The ribs provide stability to the printed circuit board connector and prevent the printed circuit board connector from being rotated relative to the printed circuit board. The sealed connector system may be provided with a cable housing ground shield proximate the header mating end of the cable housing and a header assembly ground shield may be provided in a cable housing receiving opening of the header assembly, whereby the cable housing ground shield and the header assembly ground shield are placed in electrical engagement with each other.

21 Claims, 17 Drawing Sheets

U.S. PATENT DOCUMENTS 6,976,865 B2 12/2005 Wu
7,059,901 B2 * 6/2006 Morita et al. ..... 439/587
7,223,121 B2 * 5/2007 Moriyama et al. ..... 439/497
2004/0166715 A1 8/2004 Parrish et al.
2007/0178730 A1 8/2007 Major et al.

* cited by examiner

SEALED CONNECTOR ASSEMBLY

FIELD OF THE INVENTION

The invention relates to cable assemblies that can be used in harsh environments. In particular, the invention is directed to a sealed cable assembly and sealed connector system and components therefore.

BACKGROUND OF THE INVENTION

Electrical connector assemblies have long been used in environments that are harmful to the contacts. In these environments, the electrical connection between contacts can fail, causing the device in which the connector assemblies are used to also fail. In order to provide a more reliable electrical connection, seals have been applied to the connectors, to isolate the contacts from the harsh environments. These types of sealed connectors have proven beneficial in certain environments and with certain types of cable connectors.

The use of power and/or signal connections in outdoor message centers and video scoreboards are applications in which the environment can effect the reliability of the electrical connection between components. A large message center or video screen can have many individual screens or pixels that act together to form the overall image. These pixels must be interconnected and have both power and signal delivered thereto to perform properly. As these message centers and video scoreboards are outdoors, it is obvious that environment factors such as moisture must be accounted for in order for the electrical connection to be reliably maintained over time. To date, many of the pixels have had sealed boxes attached to the back thereof, in which the electrical components were housed. The boxes were sealed, and cables would extend between the sealed boxes. However, the sealing of these boxes can be expensive and can make for difficult maintenance issues. It would, therefore, be beneficial to provide sealed cable assemblies, thereby reducing the need to have sealed boxes. As the cable assemblies required for operation of the pixels requires multiple signal and power feeds, the use of ribbon cable assemblies and/or cable assemblies with multiple cables is advantageous. To date, it has been difficult to provide such cable assemblies with the appropriate sealing to withstand the harsh environmental conditions.

Additionally, as the message boards and video scoreboards are made of many pixels, the cost of the electrical components can be significant. The components include the cable assemblies and the circuit boards that control the operation of the pixel. In order to perform properly, the circuit boards must have numerous components mounted thereon, which causes the circuit boards to be relatively large and expensive. Therefore, it would be desirable to have a connector assembly, and in particular a circuit board header, which could reliably mount, both physically and electrically, to the circuit board in less space than traditional connectors, thereby freeing space for other components and ultimately allowing for the reduction in size and expense of the circuit board.

SUMMARY OF THE INVENTION

One aspect of the invention is directed to a sealed ribbon cable assembly. The cable assembly has a housing with a header mating end, a ribbon cable receiving end and contacts provided therein. A ribbon cable is positioned proximate the ribbon cable receiving end and is terminated to the contacts to provide an electrical connection therebetween. A cover is overmolded over a portion of the housing and a portion of the ribbon cable. The cover being one continuous member that acts as a seal to prevent contaminants from effecting the electrical connection between the contacts positioned in the housing and the ribbon cable.

The overmolded cover is made from thermoplastic having the appropriate strength and resilient characteristics and has a housing sealing portion that covers the ribbon cable receiving end, a header sealing portion that extends from the housing sealing portion in a direction toward the header mating end, and a cable sealing portion that extends from the housing sealing portion in a direction away from the header mating end. The header sealing portion is configured to cooperate with an opening in a mating header to provide a seal therebetween. Alternately, a separate header sealing member extends from proximate the housing sealing portion in a direction toward a header mating end of the cable connector, the separate header sealing member is configured to cooperate with an opening in the header assembly to provide a seal therebetween. The cable sealing portion cooperates with the ribbon cable to form a seal around the ribbon cable and to provide strain relief, providing additional protection to the ribbon cable.

Another aspect of the invention is directed to a sealed connector system having a sealed cable assembly and a printed circuit board header assembly. The sealed cable assembly has a cable housing and a cable terminated thereto. The cable housing has a header mating end and a cable receiving end that cooperates with the cable. A cover, as described above, is overmolded over a portion of the cable housing and a portion of the cable. The cover is one continuous member that acts as a seal to prevent contaminants from entering the cable housing. A printed circuit board header assembly is mated to the cable housing. The header assembly has recesses provided proximate a circuit board mounting surface, with the recesses being configured to provide additional space on a circuit board on which the header assembly is mounted.

The sealed connector system may be provided with a cable housing ground shield proximate the header mating end of the cable housing and a header assembly ground shield may be provided in a cable housing receiving opening of the header assembly, whereby the cable housing ground shield and the header assembly ground shield are placed in electrical engagement with each other.

Another aspect of the invention is directed to a printed circuit board connector having a mating face and a circuit board mounting face. A connector receiving opening extends from the mating face and is dimensioned to receive a mating connector therein. Contacts extend from the connector receiving opening to beyond the circuit board mounting face, thereby allowing the printed circuit board connector to be mounted to a printed circuit board. Recessed areas are provided on either side of an elongated circuit board contact area of the circuit board mating surface. The recessed areas minimize the space required by the printed circuit board connector on the printed circuit board, allowing other components to be provided on the printed circuit board in the space made available by the recesses. Legs or ribs may be provided proximate the ends of the circuit board contact area. The ribs provide stability to the printed circuit board connector and prevent the printed circuit board connector from being rotated relative to the printed circuit board.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
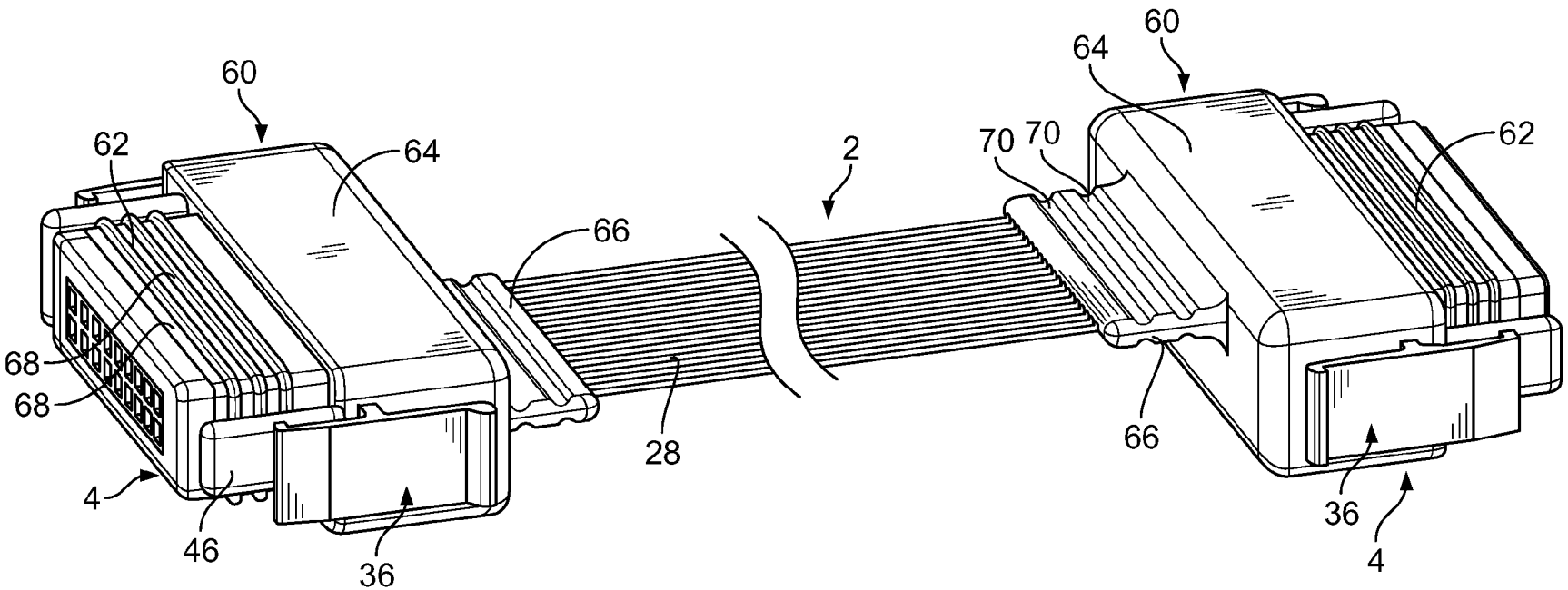
FIG. 1 is a perspective view of a ribbon cable assembly with sealed ribbon connector assemblies provided at either end thereof.

Referring to FIG. 1, a sealed ribbon cable assembly 2 is shown. The ribbon cable assembly 2 is manufactured to the desired length and has a sealed ribbon cable connector assembly 4 terminated thereto at either end.

Figure 2:
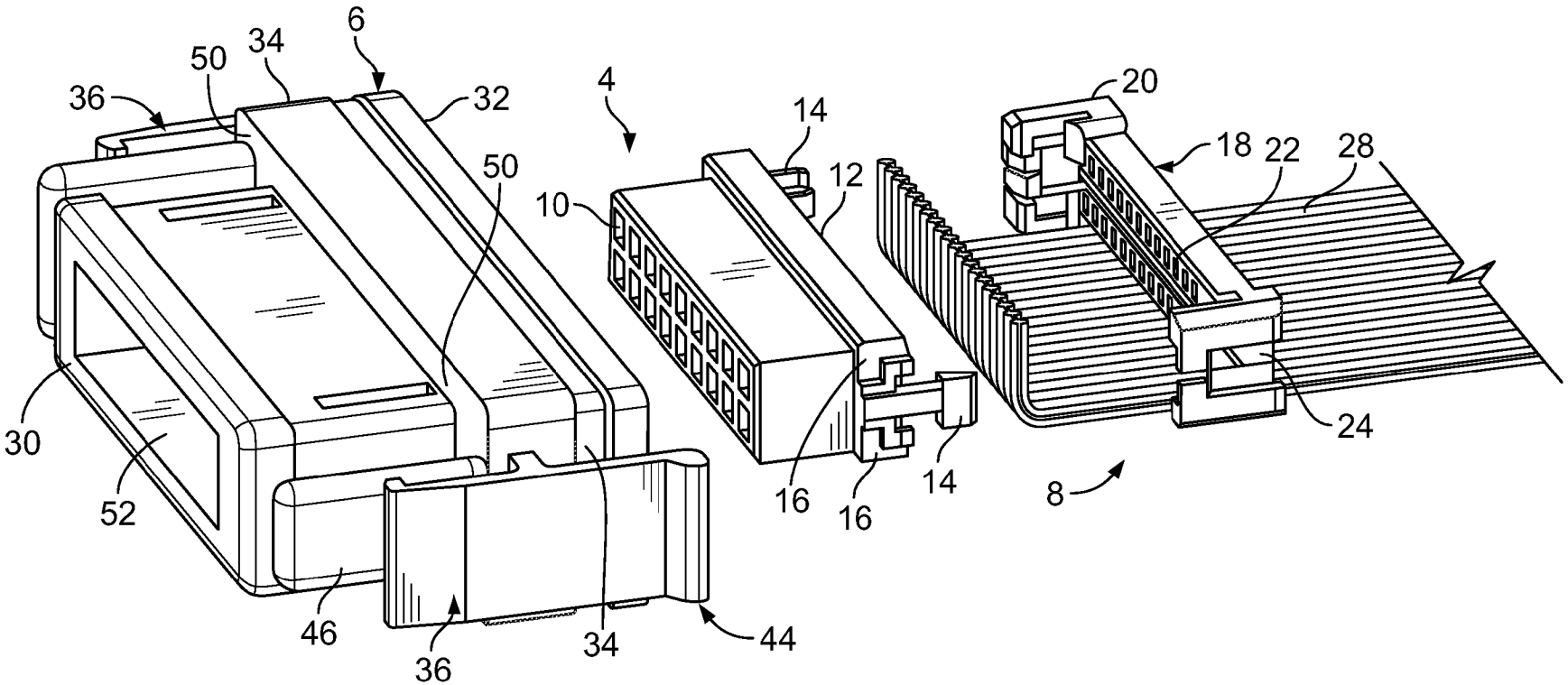
FIG. 2 is an exploded perspective view of one of the sealed ribbon connector assemblies of FIG. 1 prior to the overmolding thereof.

As best shown in FIG. 2, each ribbon cable connector assembly 4 has a molded housing 6 and a contact receiving housing 8. The contact receiving housing 8 has a header mating surface 10 and an oppositely facing ribbon cable mating surface 12. The ribbon cable mating surface 12 has insulation displacement contacts (not shown) extending therefrom in a direction away from the header mating surface 10. At either end of the ribbon cable mating surface 12, a locking latch 14 extends from the contact receiving housing 8 in a direction essentially perpendicular to the ribbon cable mating surface 12 and away from the header mating surface 10. Locking tabs 16 are positioned on either side of the base of each locking latch 14. A cover 18 is positioned proximate the ribbon cable mating surface 12. The cover 18 has a ribbon cable receiving surface 20 that faces the ribbon cable mating surface 12. The ribbon cable receiving surface 20 has ribbon cable receiving grooves 22 provided thereon to cooperate with the ribbon cable assembly 2 when the ribbon cable connector assembly 4 is fully mated. Latch receiving recesses 24 are positioned at either end of the cover 18. The latching receiving recesses 24 are configured to align with the locking latches 14 of the contact receiving housing 8.

Figure 3:
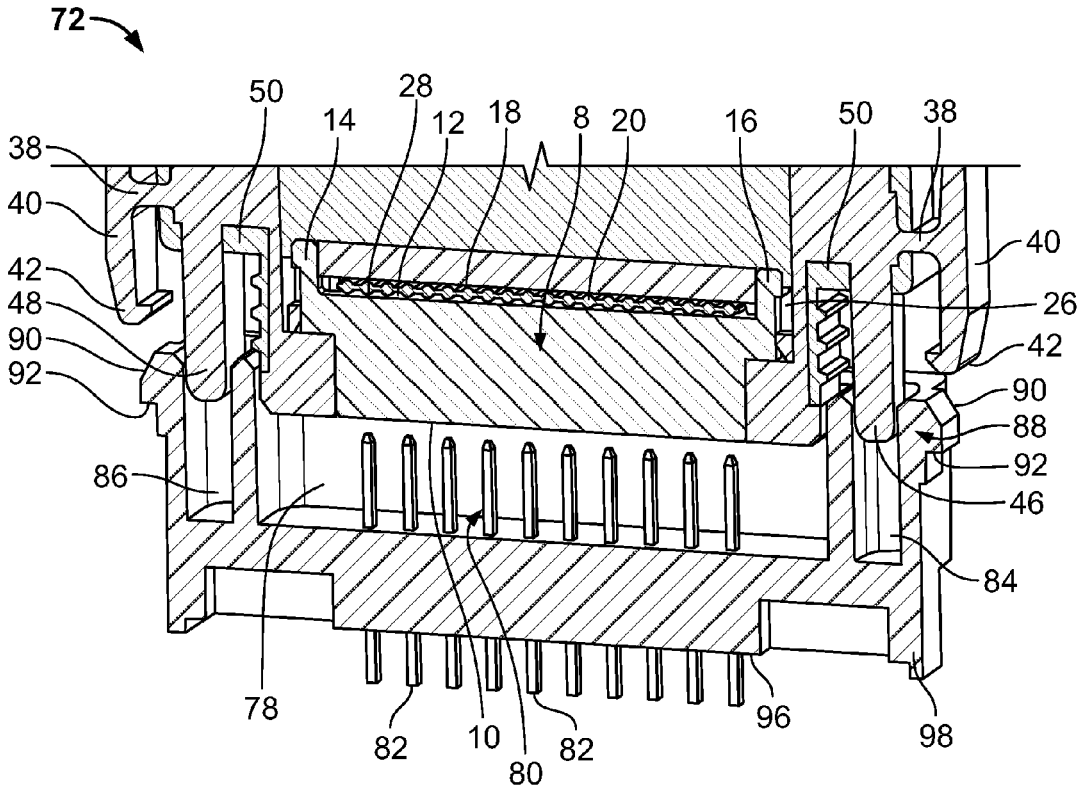
FIG. 3 is a cross sectional view of the sealed ribbon connector assembly and the header as the sealed ribbon connector assembly and the header are moved toward the mating position.

As best represented in FIG. 3, when the contact receiving housing 8 is fully mated to a cable 28, the cable 28 is maintained in position between the ribbon cable mating surface 12 and the ribbon cable receiving surface 20. In this position, the locking tabs 16 cooperate with the latch receiving recess 26 to prevent the removal of the cable 28 from the contact receiving housing 8. The operation of the contact receiving housing 8 is more fully described in Tyco Electronics Application Specification 114-40038 Rev A dated 02 May 01 and entitled "AMP-LATCH 2 mm Receptacle Connectors" which is hereby incorporated by reference in its entirety.

Figure 4:
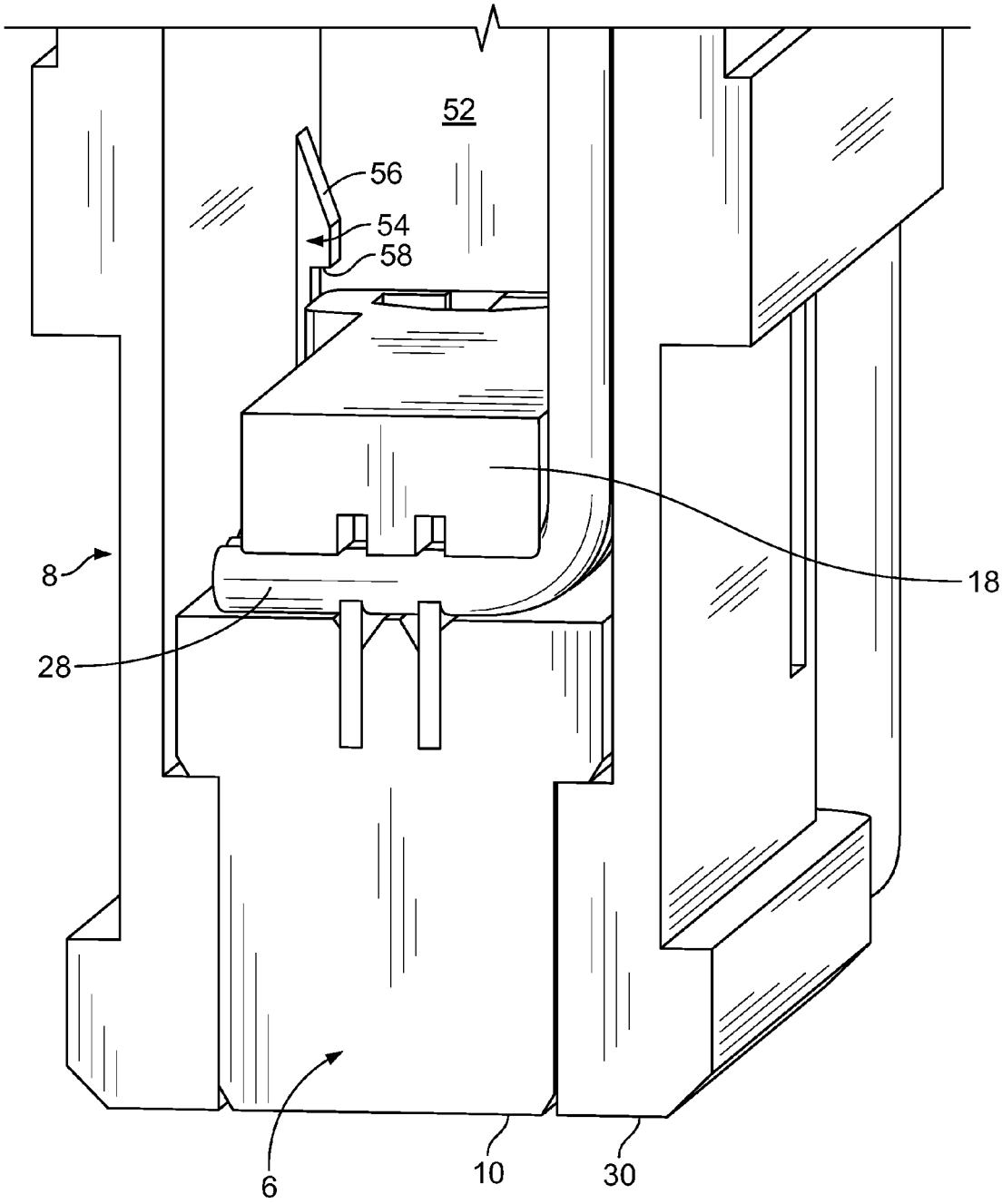
FIG. 4 is a cross sectional view of the mated sealed ribbon connector assembly.

As best shown in FIGS. 2 and 3, molded housing 6 has a header mating end 30, housing receiving end 32 and graduated end walls 34 which extend therebetween. Latch arms 36 extend from end walls 34. As best shown in FIGS. 3 and 4, each latch arm has a pivot member 38 that extends from, and is essentially perpendicular to, a respective end wall 34. Engagement members 40 extend from pivot members 38 and have latching projections 42 at one end and disengagement projections 44 (FIG. 2) at the opposite ends. The engagement members 40 are configured to pivot around pivot members 38 when the latch arms 36 are moved into or out of engagement with a mating header.

Referring to FIGS. 2 and 3, small keying projection 46 and large keying projection 48 extend from transition sections 50 of end walls 34 in a direction toward the plane of the header mating end 30. The keying projections 46, 48 are essentially parallel to the portions of the end walls 34 which extend between the transition sections 50 and the header mating end 30. The keying projections 46, 48 are configured to prevent the sealed ribbon cable connector assembly 4 from being improperly mated with a mating connector, as will be more fully described below.

Referring to FIG. 4, with the ribbon cable 28 properly terminated to the contact receiving housing 8, the contact receiving housing 8 is moved into the housing receiving opening 52 of the molded housing 8. This continues until the header mating surface 10 of housing 8 engages the header mating end 30 of housing 6. As this insertion occurs side surface of the housing 8 contact housing retaining latches 54 positioned in housing receiving opening 52. The insertion of the housing 8 into the opening 52 causes the side surfaces to engage ramps 56. As insertion continues, the side surfaces ride up the ramps 56, causing the retaining latches and wall of the opening 52 to be resiliently deformed outward, thereby allowing the insertion of the housing 8 to continue. As the housing 8 is properly inserted into the opening, the side surface move beyond the ramps 56 and the retaining latch 54, allowing the retaining latch 54 and the wall of the opening 52 to resiliently return to their unstressed position, as shown in FIG. 4. In this position, latching shoulders 58 of retaining latches 54 are provided proximate an end surface of the cover 18, thereby preventing the accidental removal of the housing 8 from the opening 52. As shown in FIG. 4, the shoulder 58 and surface of cover 18 do not have to be in constant engagement, it is sufficient for the shoulder and surface to be in close proximity, so that as the connector assembly 4 is mated to a header, the header mating surface 10 of the contact receiving housing 8 will be maintained in close proximity to the header mating end 30 of molded housing 6.

Referring to FIGS. 1, 2, 5 and 6, a cover 60 is molded over the molded housing 6 when the contact receiving housing 8 is properly inserted therein. The overmolded cover 60 has a header sealing portion 62, a housing sealing portion 64 and a cable sealing portion 66. The housing sealing portion 64 is molded over the back portion of the molded housing 6 and covers the back of the housing receiving opening. Extending from the housing sealing portion 64 in a direction toward the header mating surface end 30 is the header sealing portion 62. The header sealing portion 62 has a series of ribs 68 which are integrally molded therein. The cable sealing portion 66 extends from the housing sealing portion 64 in the opposite direction from the header sealing portion 62. The cover 60 is overmolded thereby creating a seal about the molded housing 6 and the ribbon cable 28. The allows the ribbon cable connector assembly to be used in environments in which ribbon cables traditionally have not be used, as it has proven difficult to provide a sealed ribbon cable assembly. The material used for the overmolded cover 60 is any commonly available thermoplastic elastomeric material with the appropriate strength and elasticity requirements. The cable sealing portion 66 not only acts as a seal around the ribbon cable 28, but it also acts as a strain relief, providing additional protection from the ribbon cable 28 being accidentally removed from the contact receiving housing 8. Indents 70 are molded into cable sealing portion 66 to allow the cable sealing portion 66 to more positively engage the ribbon cable 28 to provide additional strain relief.

Figure 5:
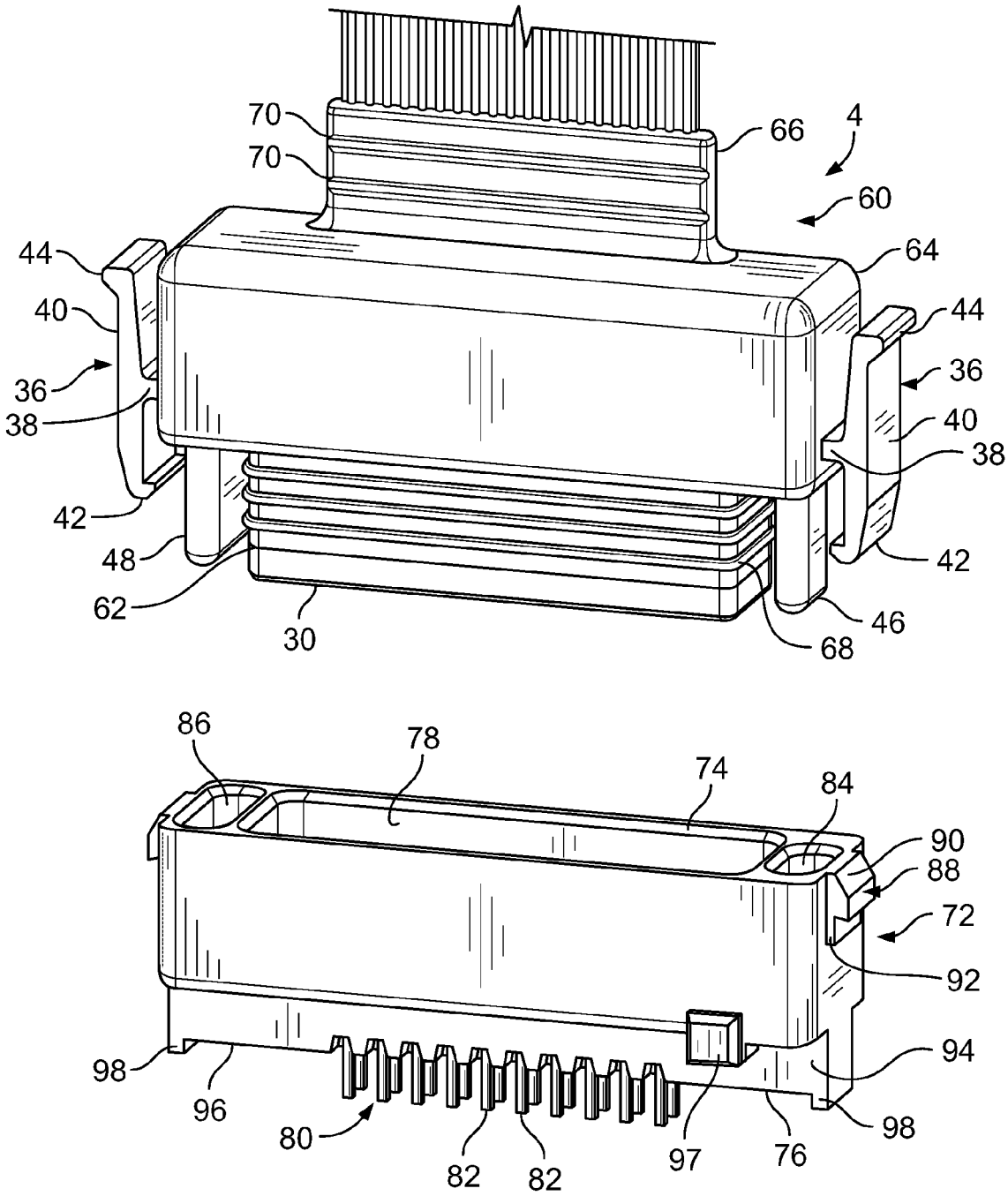
FIG. 5 is a perspective view of the one of the sealed ribbon connector assemblies prior to mating with a header.
Figure 7:
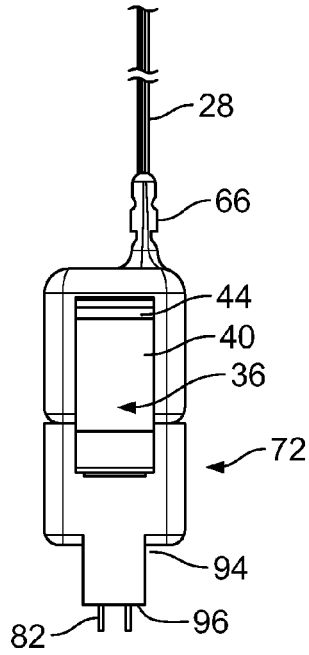
FIG. 7 is a side view of the mated sealed ribbon connector assembly and header as shown in FIG. 6.

Referring to FIG. 5, a header 72 is shown. The header 72 has a connector receiving face 74 and a circuit board mounting face 76. A connector receiving opening 78 is provided in the header 72. The opening 78 extends from the connector receiving face 74 toward the mounting face 76 and is dimensioned to receive the header mounting end 30 of the cable connector assembly 4 therein. Contacts 80 are mounted in the header 72. The contacts 80 extend into the connector receiving opening 78. Circuit board engagement sections 82 of contacts 80 also extend beyond the circuit board mounting face 76. In the embodiment shown in FIGS. 3 through 7, the circuit board engagement sections 82 extend in a direction that is generally perpendicular to the circuit board mounting face 76, thereby allowing the engagement sections 82 to be mounted in through holes provided on the printed circuit board (not shown). Alternatively, as shown in FIG. 8, the engagement sections 82*a* may be bent to be essentially parallel to the circuit board mounting face 76, thereby allowing the engagement sections 82*a* to be mounted on to surface mount pads of the printed circuit board (not shown).

Keying openings 84, 86 are provided on either side of connector receiving opening and extend from the connector receiving face 74 toward the mounting face 76. Keying opening 86 is larger than keying opening 84, thereby allowing only the appropriate mating connector assemblies to be mated thereto. As shown in FIG. 3, the keying projections 46, 48 must be placed in proper alignment with keying openings 84, 86 for the connector assembly and header to be mated. If the keying projections 46, 48 and keying openings 84, 86 are not aligned or are not of the complementary configurations, the connector assembly 4 and header 72 cannot mate and the contacts of the connector assembly 4 and header 72 will not be allowed to physically or electrically engage with each other, thereby preventing any damage or shortage to the contacts.

Latching projections 88 are provided at either end of the header 72 to cooperate with latching projections 42 of connector assembly 4 when the connector assembly 4 is mated with the header 72. As the connector assembly 4 is moved from the position shown in FIG. 5 to the fully inserted position of FIGS. 6 and 7, the latching projections 42 of latch arms 36 engage ramp 90, causing the latching projections 42 to resiliently pivot about pivot member 38. As the fully inserted position is reached, the latching projections 42 move beyond the ramp 90 and resiliently return to their unstressed position. In this position, the latching projections 42 are positioned in close proximity to the shoulders 92, thereby preventing the accidental removal of the connector assembly 4 from the header 72.

Figure 8:
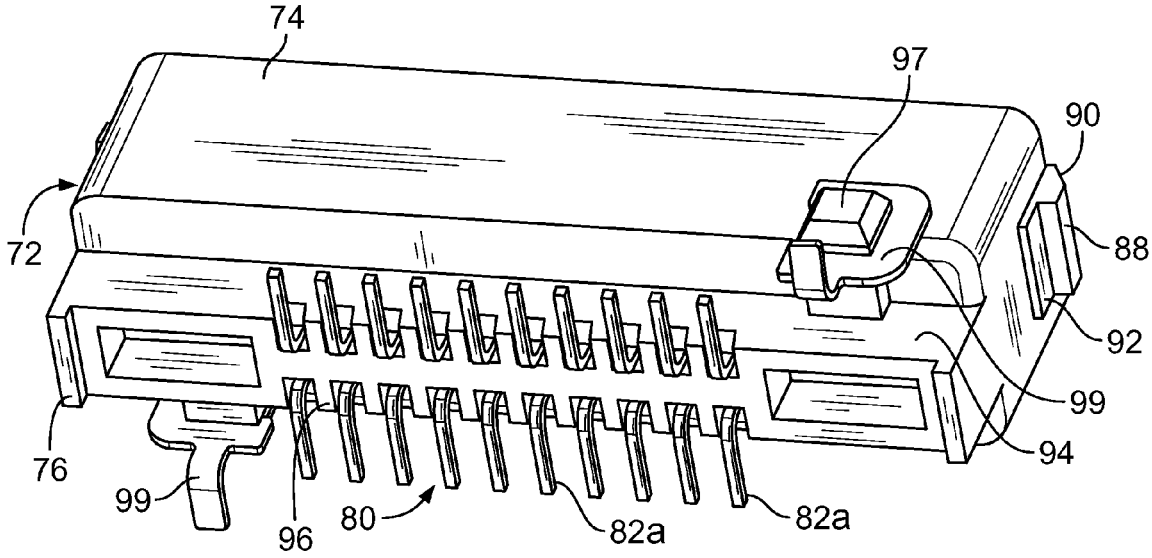
FIG. 8 is a perspective view of an alternate surface mount header that can be mated to the sealed ribbon connector assembly of FIG. 1.
Figure 9:
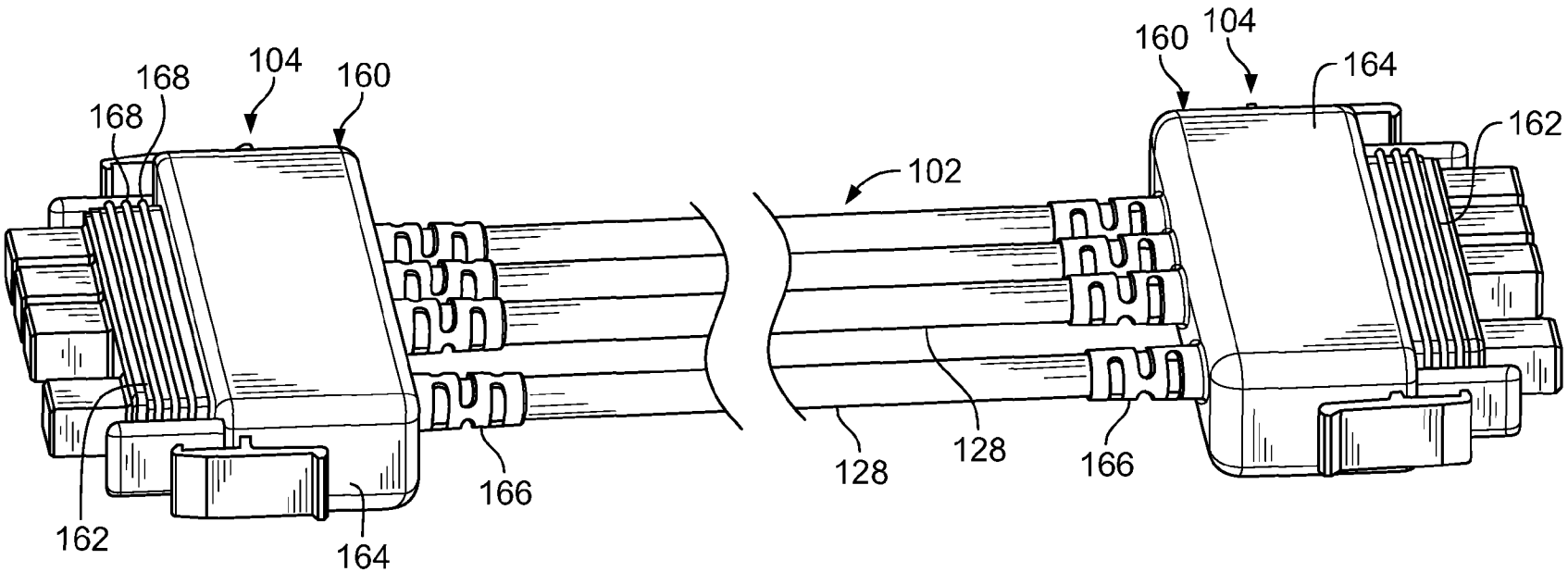
FIG. 9 is a perspective view of a first alternate cable assembly with sealed connector assemblies provided at either end thereof.

As best shown in FIG. 8., the housing of the header 72 is configured to have a sealed interface between the housing and the contacts 80. As the connector assembly 4 and header 72 are sealed, the circuit board must also be sealed to provide a reliable electrical signal. In order to seal the circuit board, a potting compound is spread over the components thereof. As the compound should not be allowed to wick up the contacts 80, the header 72 must be configured to prevent this from occurring whether the contacts are through hole mounted or surface mounted.

Figure 6:
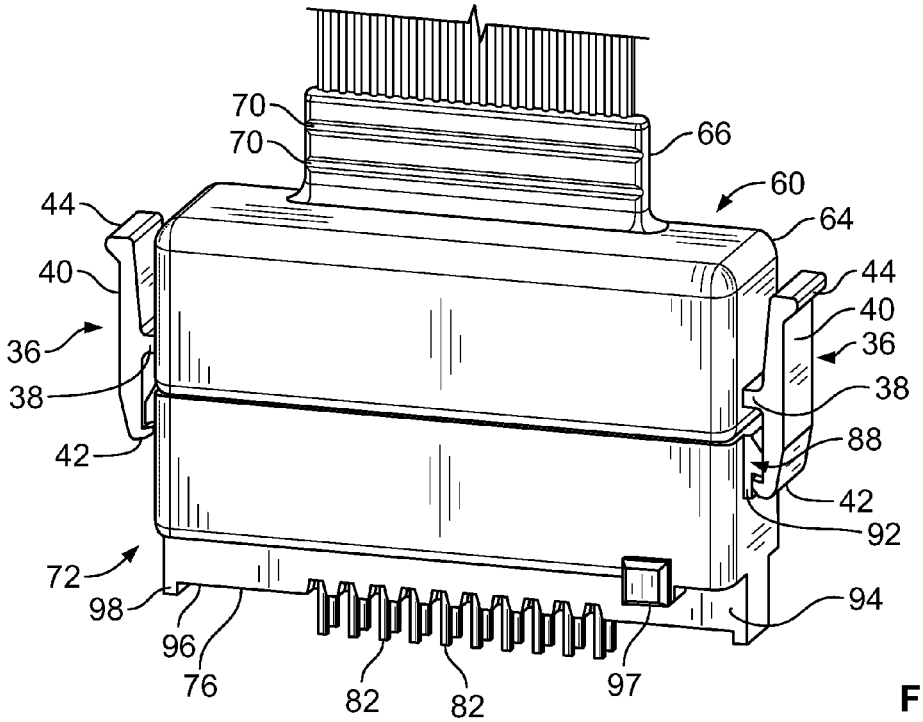
FIG. 6 is a perspective view showing the sealed ribbon connector assembly and the header of FIG. 5 in a fully mated position.

When the connector assembly 4 is fully mated to the header 72, as shown in FIGS. 5 and 6, the header sealing portion 62 of the overmolded cover 60 is positioned in the connector receiving opening 78. The opening 78 and sealing portion 62 are dimensioned such that in this position, the sealing portion 62 will be placed in engagement with the interior walls of the opening 78 thereby forming a seal into which water or other similar environmental contaminants cannot enter. As the manufacturing tolerances are difficult to precisely maintain, the ribs 68 allow for some variation in the tolerances, as the ribs can be either partially or fully compressed or deformed to provide an interference fit, thereby ensuring for a sealed interface.

Referring to FIGS. 5, 6, 7 and 8 header 72 has a unique printed circuit board footprint. As space on printed circuit boards is always at a premium, it is important to design headers that perform all or more functions than previous headers while occupying less board space. To achieve this result, the circuit board mounting face 76 of header 72 has recessed areas 94 on either side of the elongated circuit board contact area 96. By providing the recessed areas 94, other components can be provided on the circuit board in areas that were previously occupied by the header. Ribs or legs 98 are provided proximate the ends of contact area 96 and extend in a direction which is essentially perpendicular to the longitudinal axis of the elongated circuit board contact area. The ribs 98 provide stability to the header 72 and help prevent it form rotating to either side, which could result in damage to the electrical connection between the header and the printed circuit board and could also damage other components on the circuit board. A projection 97 is provided on a side wall of the header (FIG. 8). For surface mount applications, the projection 97 cooperates with a hold down member 99 that is attached to the printed circuit board to prevent the accidental removal of the header from the circuit board. The use of the projection 97 and header 99 helps to maintain the header on the circuit board and helps to prevent damage to the contacts if the header is inadvertently bumped.

Referring to FIGS. 9 through 14, a first alternate embodiment of the invention, a sealed cable assembly 102 is shown. The cable assembly 102 is manufactured to the desired length and has a sealed cable connector assembly 104 terminated thereto at either end.

Figure 10:
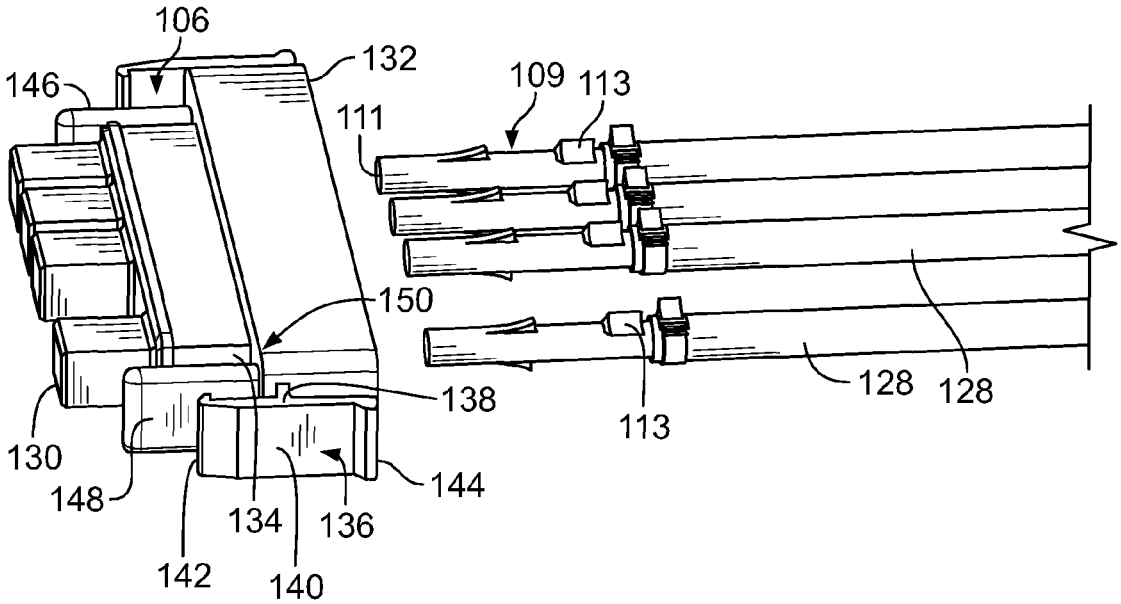
FIG. 10 is an exploded perspective view of one of the sealed ribbon connector assemblies of FIG. 9 prior to the overmolding thereof.
Figure 14:
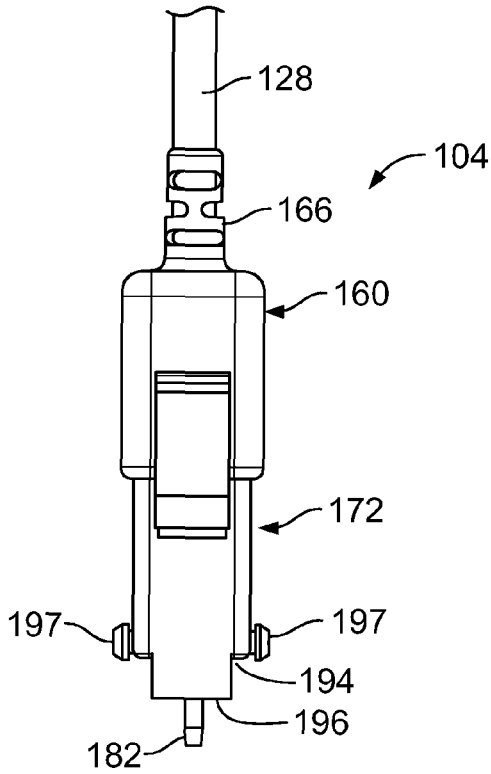
FIG. 14 is a side view of the mated sealed connector assembly and header as shown in FIG. 13.
Figure 12:
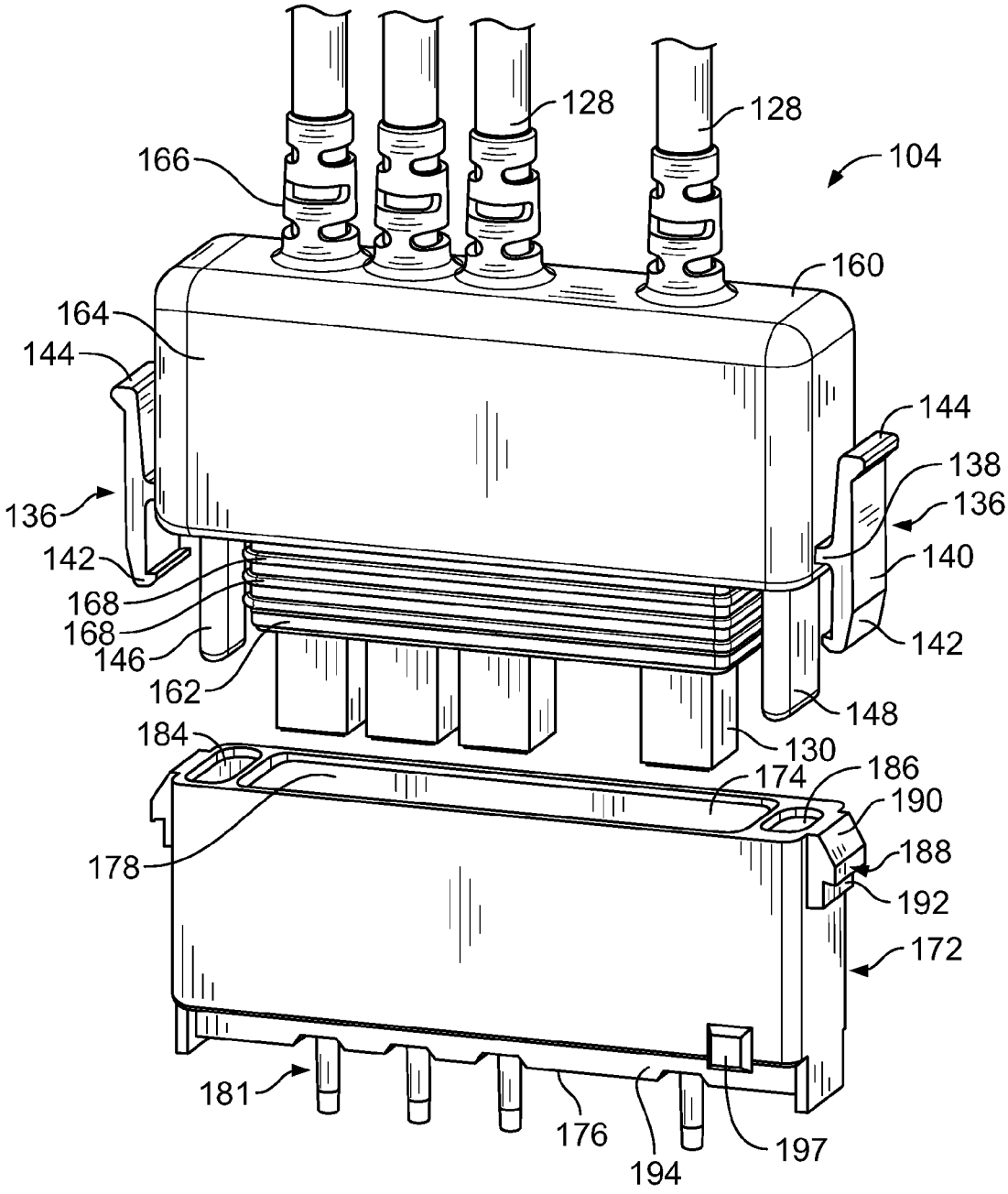
FIG. 12 is a perspective view of the one of the sealed connector assemblies of FIG. 9 prior to mating with a header.
Figure 13:
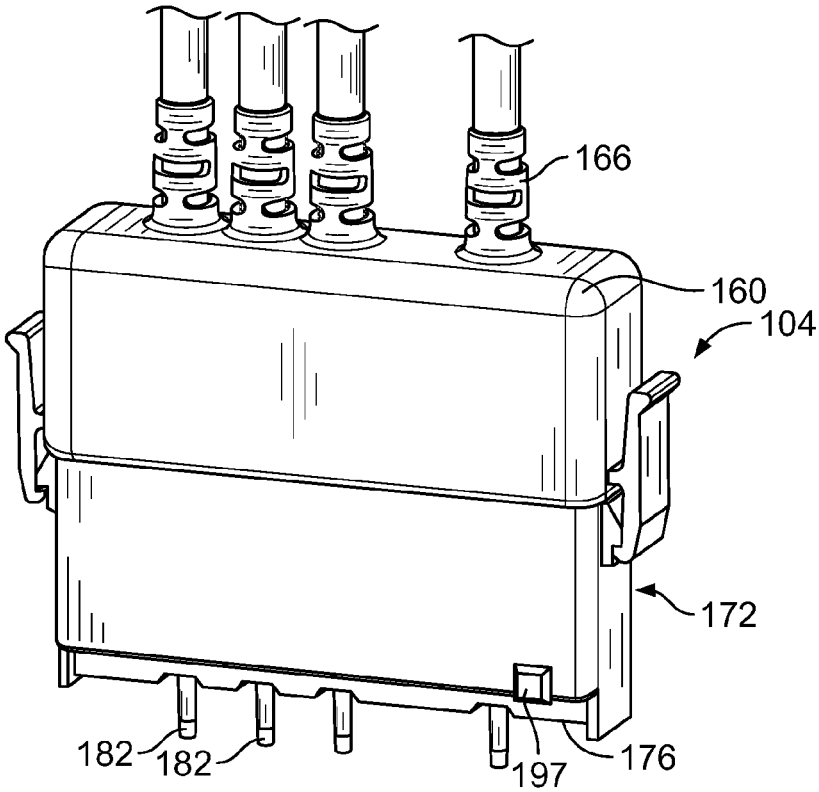
FIG. 13 is a perspective view showing the sealed connector assembly and the header of FIG. 12 in a fully mated position.

As best shown in FIG. 10, each cable connector assembly 104 has a molded housing 106. The molded housing 106 has a header mating end 130, cable receiving end 132 and graduated end walls 134 which extend therebetween. Latch arms 136 extend from end walls 134. As best shown in FIGS. 12 and 13, each latch arm has a pivot member 138 that extends from, and is essentially perpendicular to, a respective end wall 134. Engagement members 140 extend from pivot members 138 and have latching projections 142 at one end and disengagement projections 144 at the opposite ends. The engagement members 140 are configured to pivot around pivot members 138 when the latch arms 136 are moved into or out of engagement with a mating header.

Figure 11:
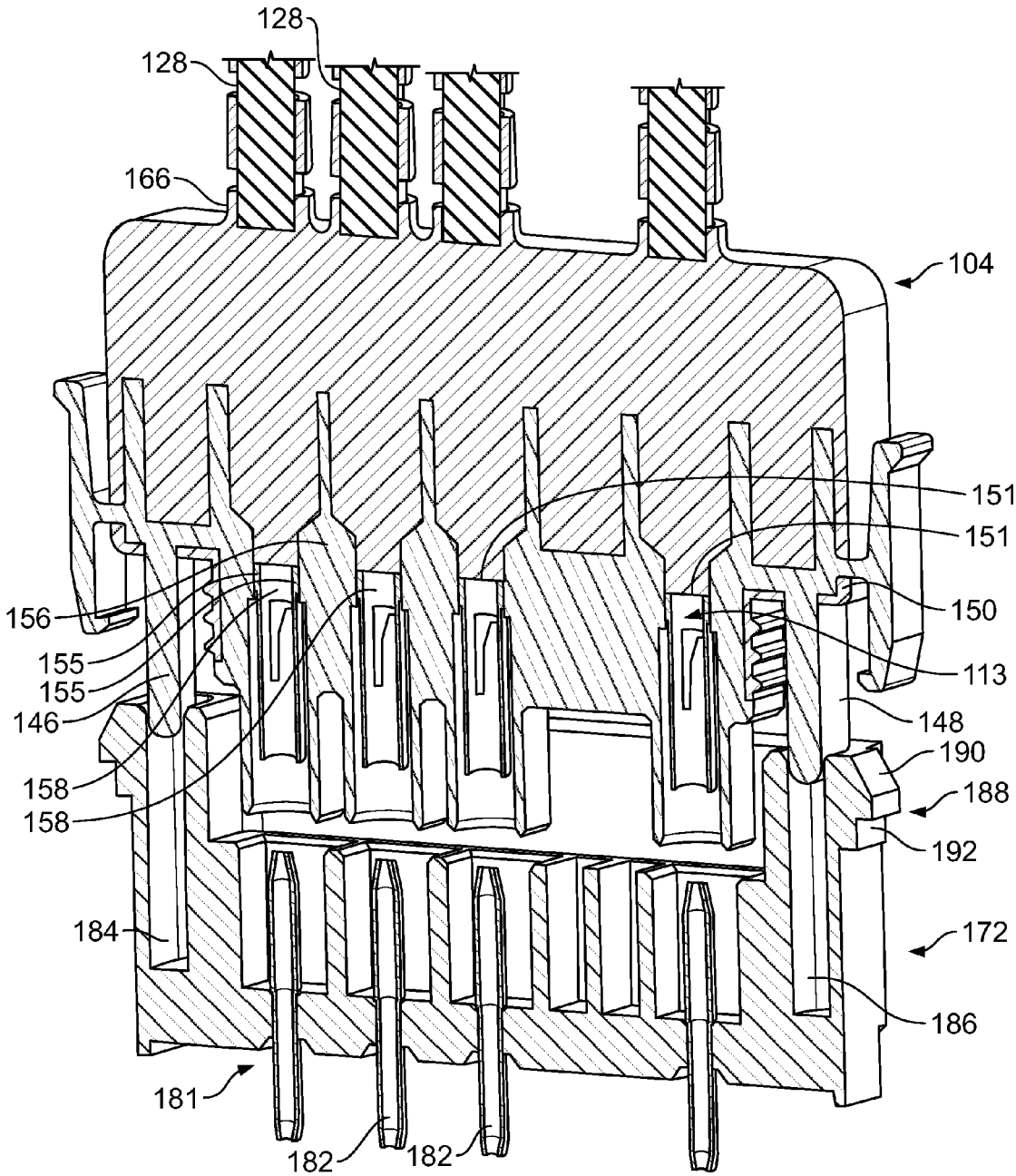
FIG. 11 is a cross sectional view of the sealed connector assembly and the header as the sealed connector assembly and the header are moved toward the mating position.

Referring to FIGS. 10 and 11, small keying projection 146 and large keying projection 148 extend from transition sections 150 of end walls 134 in a direction toward the plane of the header mating end 130. The keying projections 146, 148 are essentially parallel to the portions of the end walls 134 which extend between the transition sections 150 and the header mating end 130. The keying projections 146, 148 are configured to prevent the sealed cable connector assembly 104 from being improperly mated with a mating connector, as will be more fully described below.

As is generally known in the industry, cables 128 with contacts 109 terminated thereto are moved into contact receiving openings 151. This continues until free ends 111 of contacts 109 engage the header mating end 130 of housing 106. As this insertion occurs the outer surface of the cylindrical contacts 109 engages contact retaining latches 155 (FIG. 11) positioned in contact receiving openings 151. The insertion of the each contact 109 into respective opening 151 causes the outside surface to engage ramp 156. As insertion continues, the outside surfaces rides up the ramp 156, causing the retaining latches 155 and wall of the opening 151 to be resiliently deformed outward, thereby allowing the insertion of the contact 109 to continue. As the contact 109 is properly inserted into the opening 151, the outside surface moves beyond the ramp 156 and the retaining latch 155, allowing the retaining latch 155 and the wall of the opening 151 to resiliently return to their unstressed position. In this position, latching shoulder 158 of retaining latch 155 is provided proximate a cable receiving end 113 of the contact 109, thereby preventing the accidental removal of the contact 109 from the opening 151. As shown in FIG. 11, the shoulder 158 and cable receiving end 113 do not have to be in constant engagement, it is sufficient for the shoulder and cable receiving end to be in close proximity, so that as the connector assembly 104 is mated to a header, the free ends 111 of the contacts 109 will be maintained in close proximity to the header mating end 130 of molded housing 106. This process is repeated for the insertion of each contact 109 into the contact receiving openings 151.

Referring to FIGS. 9, 10, 12 and 13, a cover 160 is molded over the molded housing 106 when the contacts 109 are properly inserted therein. The overmolded cover 160 has a header sealing portion 162, a housing sealing portion 164 and a plurality of cable sealing portion 166. The housing sealing portion 164 is molded over the back portion of the molded housing 106 and covers the back of the contact receiving openings 151. Extending from the housing sealing portion 164 in a direction toward the header mating surface end 130 is the header sealing portion 162. The header sealing portion 162 has a series of ribs 168 which are integrally molded therein. The cable sealing portions 166 extend from the housing sealing portion 164 in the opposite direction from the header sealing portion 162. The cover 160 is overmolded thereby creating a seal about the molded housing 106 and the cable 128. This allows the cable connector assembly to be used in environments in which multiple cable connectors have not traditionally been used, as it has proven difficult to provide a sealed multi cable assembly. The material used for the overmolded cover 160 is any commonly available thermoplastic elastomeric material with the appropriate strength and elasticity requirements can be used. The cable sealing portion 166 not only acts as a seal around the cable 128, but it also acts as a strain relief, providing additional protection from the cable 128 being accidentally removed from the molded housing 106.

Referring to FIG. 12, a header 172 is shown. The header 172 has a connector receiving face 174 and a circuit board mounting face 176. A connector receiving opening 178 is provided in the header 172. The opening 178 extends from the connector receiving face 174 toward the mounting face 176 and is dimensioned to receive the header mounting end 130 of the cable connector assembly 104 therein. Contacts 181 are mounted in the header 172. The contacts 181 extend into the connector receiving opening 178. Circuit board engagement sections 182 of contacts 180 also extend below the circuit board mounting face 176. In the embodiment shown in FIGS. 11 through 14, the circuit board engagement sections 182 extend in a direction that is generally perpendicular to the circuit board mounting face 176, thereby allowing the engagement sections 182 to be mounted in through holes provided on the printed circuit board (not shown). Alternatively, as shown in FIG. 15, the engagement sections **182*a* may be bent to be essentially parallel to the circuit board mounting face 176, thereby allowing the engagement sections 182*a*** to be mounted on to surface mount pads of the printed circuit board (not shown).

Keying openings 184, 186 are provided on either side of connector receiving opening and extend from the connector receiving face 174 toward the mounting face 176. Keying opening 186 is larger than keying opening 184, thereby allowing only the appropriate mating connector assemblies to be mated thereto. As shown in FIG. 11, the keying projections 146, 148 must be placed in proper alignment with keying openings 184, 186 for the connector assembly and header to be mated. If the keying projections 146, 148 and keying openings 184, 186 are not aligned or are not of the complementary configurations, the connector assembly 104 and header 172 cannot mate and the contacts of the connector assembly 104 and header 172 will not be allowed to physically or electrically engage with each other, thereby preventing any damage or shortage to the contacts.

Latching projections 188 are provided at either end of the header 172 to cooperate with latching projections 142 of connector assembly 104 when the connector assembly 104 is mated with the header 172. As the connector assembly 104 is moved from the position shown in FIG. 12 to the fully inserted position of FIGS. 13 and 14, the latching projections 142 of latch arms 136 engage ramp 190, causing the latching projections 142 to resiliently pivot about pivot member 138. As the fully inserted position is reached, the latching projections 142 move beyond the ramp 190 and resiliently return to their unstressed position. In this position, the latching projections 142 are positioned in close proximity to the shoulders 192, thereby preventing the accidental removal of the connector assembly 104 from the header 172.

Figure 15:
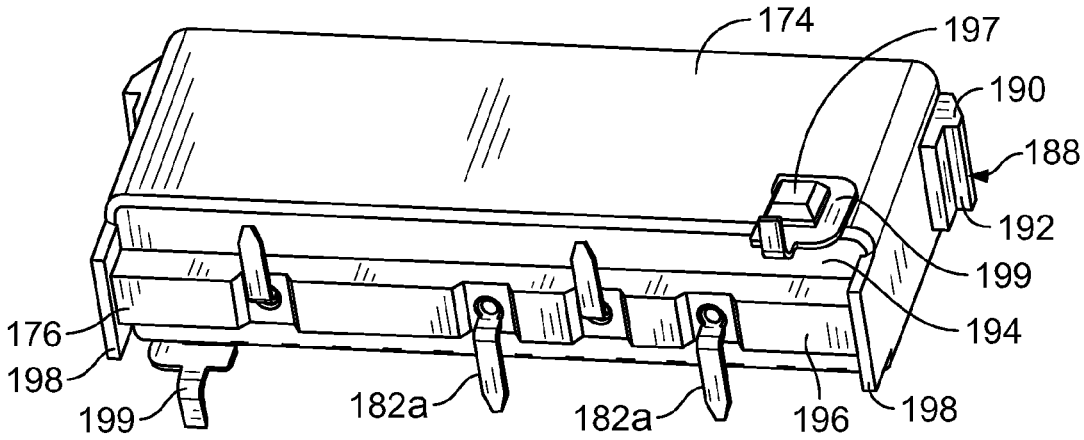
FIG. 15 is a perspective view of an alternate surface mount header that can be mated to the sealed connector assembly of FIG. 9.

As best shown in FIG. 15., the housing of the header 172 is configured to have a sealed interface between the housing and the contacts 181. As the connector assembly 104 and header 172 are sealed, the circuit board must also be sealed to provide a reliable electrical signal. In order to seal the circuit board, a potting compound is spread over the components thereof. As the compound should not be allowed to wick up the contacts 181, the header 172 must be configured to prevent this from occurring whether the contacts are through hole mounted or surface mounted.

When the connector assembly 104 is fully mated to the header 172, as shown in FIG. 13, the header sealing portion 162 of the overmolded cover 170 is positioned in the connector receiving opening 178. The opening 178 and sealing portion 162 are dimensioned such that in this position, the sealing portion 162 will be placed in engagement with the interior walls of the opening 178 thereby forming a seal into which water or other similar environmental contaminants cannot enter. As the manufacturing tolerances are difficult to precisely maintain, the ribs 168 allow for some variation in the tolerances, as the ribs can be either partially or fully compressed or deformed to ensure for a sealed interface.

Referring to FIGS. 12, 13, 14 and 15 header 172 has a unique printed circuit board footprint. As space on printed circuit boards is always at a premium, it is important to design headers that perform all or more functions than previous headers while occupying less board real estate. To achieve this result, the circuit board mounting face 176 of header 172 has recessed areas 194 on either side of the elongated circuit board contact area 196. By providing the recessed areas 194, other components can be provided on the circuit board in areas that were previously occupied by the header. Ribs 198 are provided proximate the ends of contact area 196. The ribs 198 provide stability to the header 172 and help prevent it from rotating to either side, which could result in damage to the electrical connection between the header and the printed circuit board and could also damage other components on the circuit board. A projection 197 is provided on a side wall of the header. In surface mount applications, the projection 197 cooperates with a hold down member 199 that is attached to the printed circuit board to prevent the accidental removal of the header from the circuit board. The use of the projection 197 and header 199 helps to maintain the header on the circuit board and helps to prevent damage to the contacts if the header is inadvertently bumped.

Figure 16:
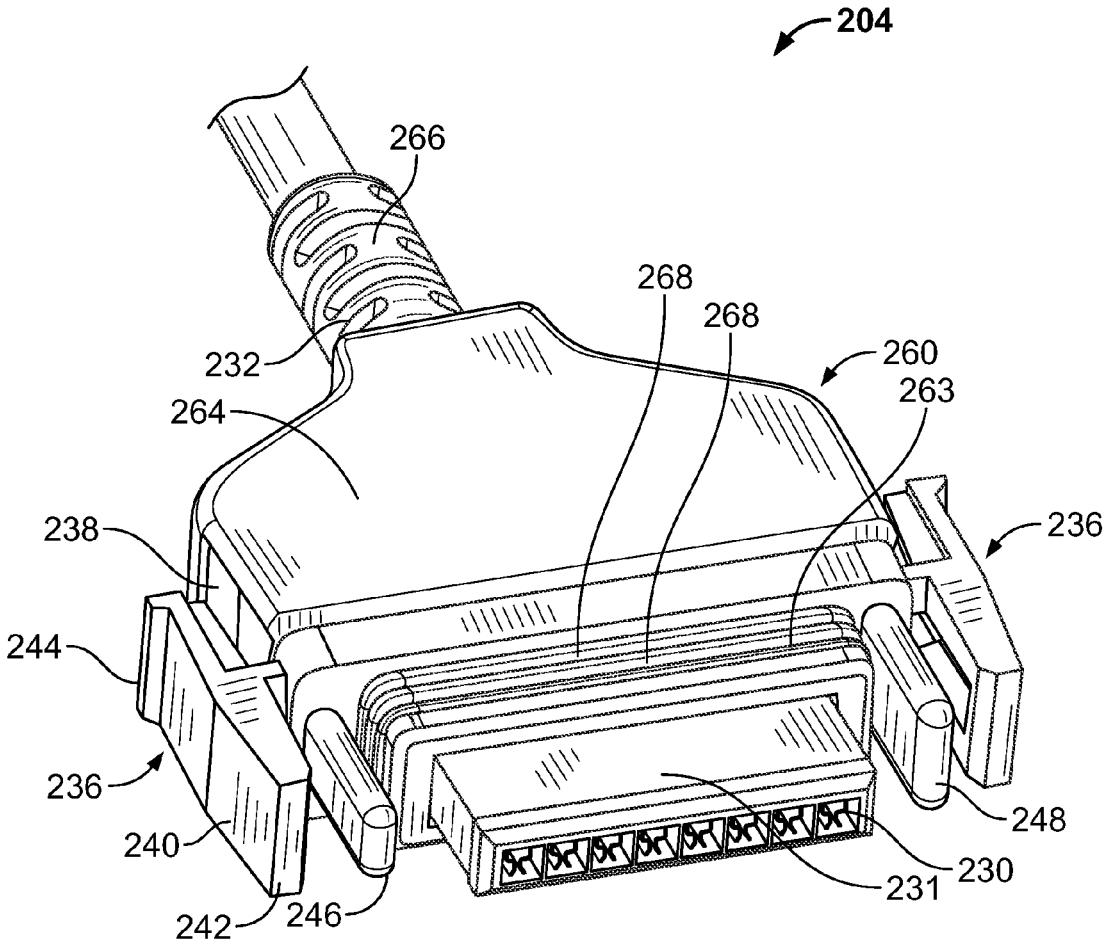
FIG. 16 is a perspective view of a third alternate sealed signal connector assembly with shielding provided thereon.
Figure 17:
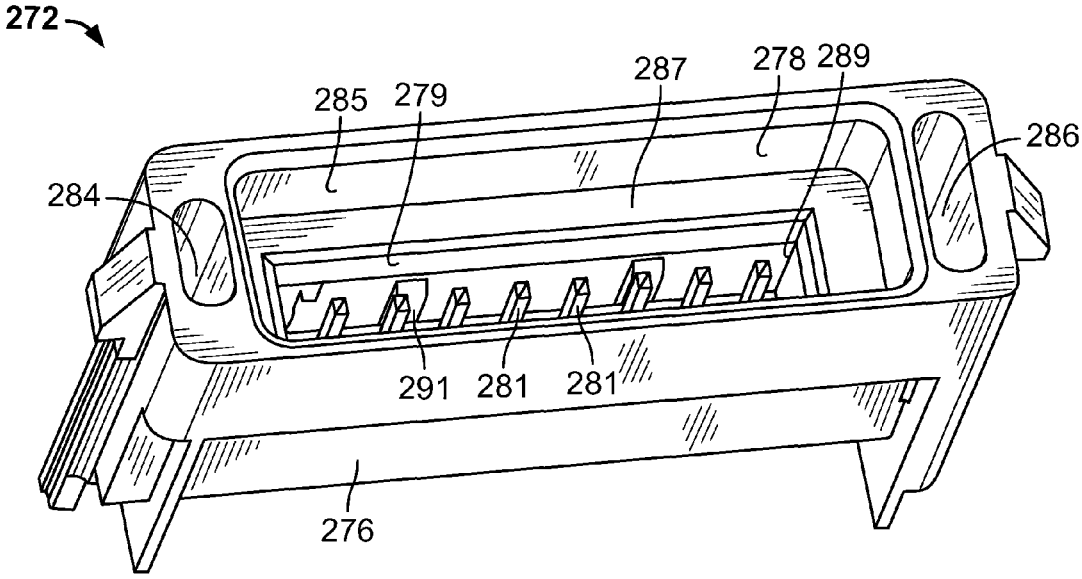
FIG. 17 is a front perspective view of a header that can be mated to the sealed signal connector assembly of FIG. 16.
Figure 18:
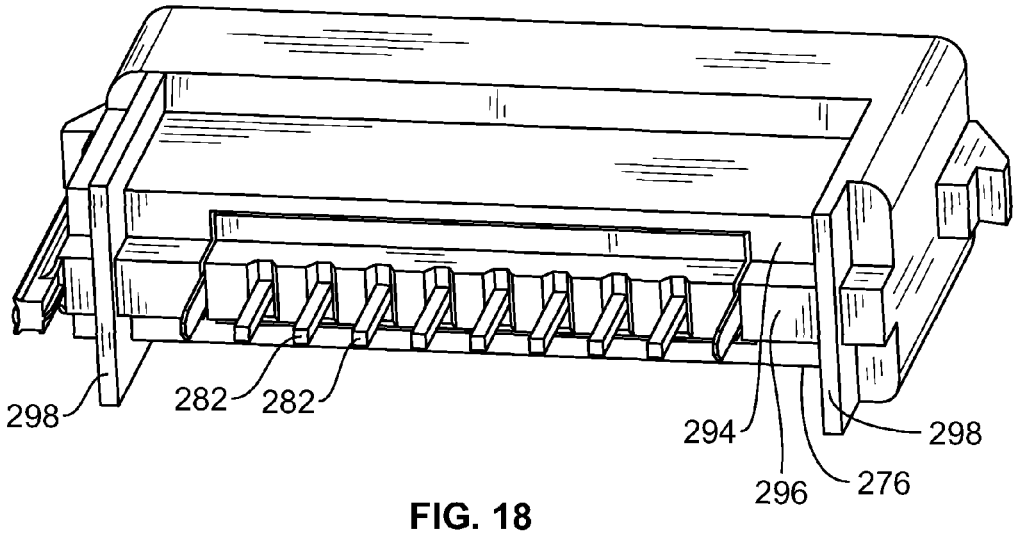
FIG. 18 is a back perspective view of the header shown in FIG. 17.

Referring to FIGS. 16 through 18, a second alternate embodiment of the invention, a shielded and sealed cable connector assembly 204 is shown. The cable assembly attached to the cable connector assembly 204 is manufactured to the desired length and has a sealed cable connector assembly 204 terminated thereto at either end.

A multi-conductor cable is terminated to contacts and the contacts are mounted in the connector assembly 204 in any known manner. The connector assembly 204 has a header mating end 230 and cable receiving end 232. Latch arms 236 extend from end walls of the assembly. As best shown in FIG. 16, each latch arm has a pivot member 238 that extends from, and is essentially perpendicular to, a respective end wall. Engagement members 240 extend from pivot members 238 and have latching projections 242 at one end and disengagement projections 244 at the opposite ends. As the latch arms 236 operate in essentially the same manner as the latch arms 36 and 136, a detailed explanation will not be repeated.

Referring to FIG. 16, small keying projection 246 and large keying projection 248 are provided on the connector assembly 204 and are configured and function as explained previously with respect to 46, 48 and 146, 148.

Referring to FIG. 16, a cover 260 is molded over the assembly. The overmolded cover 260 has a housing sealing portion 264. Provide proximate the housing sealing portion 264 and extending from the housing sealing portion 264 in a direction toward the header mating surface end 230 is the separate header sealing member 263. The header sealing member 263 has a series of ribs 268 which are integrally molded therein. The use of the separate header sealing member 263 allows the header sealing member 263 to be made from plastic or rubber material that is more flexible than the material used for the overmolding. This allows the header sealing member 263 to more easily compress when mated to the header, thereby allowing for lower insertion forces. The remainder of the cover 260 is similar to that previously described herein.

A ground shield 231 is provided proximate header mating end 230. The ground shield 231 is positioned between the header mating end 230 and the header sealing member 263. The ground shield is made from conductive material. In order to properly shield the contacts, the ground shield 231 is positioned to surround a portion of the contacts along the surfaces of the housing that are essentially parallel to the longitudinal axis of the contacts. The ground shield 231 is soldered to a braided jacket provided within the cable.

Figure 19:
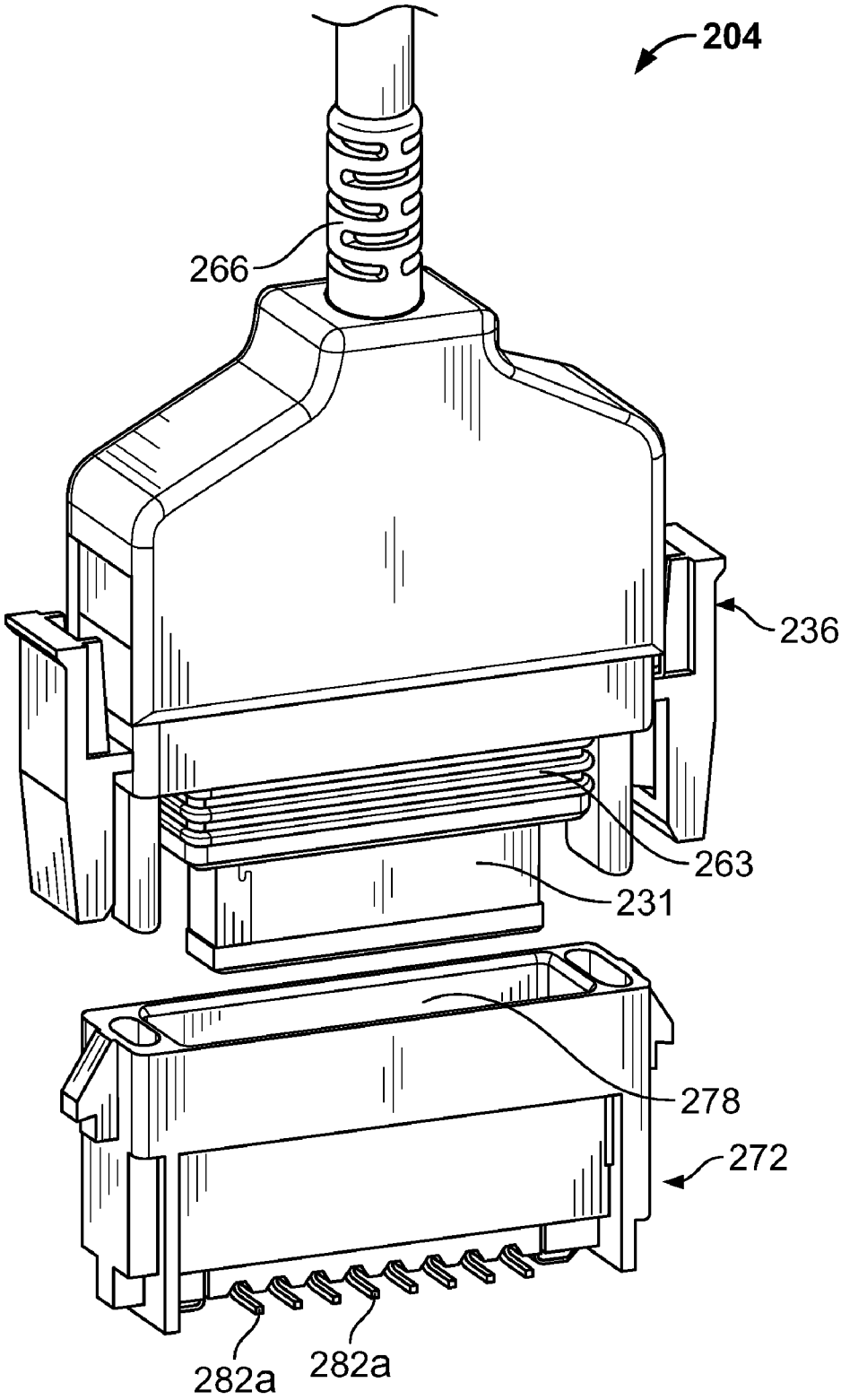
FIG. 19 is a perspective view of the sealed signal connector assembly of FIG. 16 prior to mating with an alternate surface mount header.

Referring to FIGS. 17 and 18, a header 272 is shown. The header 272 has a connector receiving opening 278. The opening 278 is dimensioned to receive the header mounting end 230, the ground shield 231 and the header sealing member 263 of the cable connector assembly 204 therein. Contacts 281 are mounted in the header 272. The contacts 281 extend into the connector receiving opening 278. Circuit board engagement sections 282 of contacts 280 also extend below the circuit board mounting face 276. In the embodiment shown in FIGS. 17 and 18, the circuit board engagement sections 282 extend in a direction that is generally perpendicular to the circuit board mounting face 276, thereby allowing the engagement sections 282 to be mounted in through holes provided on the printed circuit board (not shown). Alternatively, as shown in FIG. 19, the engagement sections **282*a* may be bent to be essentially parallel to the circuit board mounting face 276, thereby allowing the engagement sections 282*a*** to be mounted on to surface mount pads of the printed circuit board (not shown).

Opening 278 has a shielding portion 279 and a sealing portion 285 which are separated by wall 287. A ground shield 289 is provided in shielding portion 279 along the walls thereof. The ground shield 289 is made from conductive material and has resilient tines 291 that project therefrom into the opening of the shielding portion 279. Ground shield 289 has circuit board contacts which extend from the ground shield through the housing to make electrical engagement with ground paths on the printed circuit board Referring to FIG. 17, keying openings 284, 286 and latch projections 288 are provided on the header 272 and are configured and function as explained previously with respect to the other embodiments.

When the connector assembly 204 is fully mated to the header 272, the header sealing member 263 is positioned in the sealing portion 285 of the connector receiving opening 278. The sealing portion 285 and header sealing member 263 are dimensioned such that in this position, the sealing member 263 will be placed in engagement with the interior walls of the sealing portion 285 of the opening 278 thereby forming a seal into which water or other similar environmental contaminants cannot enter. As the manufacturing tolerances are difficult to precisely maintain, the ribs 268 allow for some variation in the tolerances, as the ribs can be either partially or fully compressed or deformed to ensure for a sealed interface.

Also when the connector assembly 204 is fully mated to the header 272, the ground shield 231 of the connector assembly 204 is placed in electrical engagement with the ground shield 289 positioned in shielding portion 279 of opening 278. Tines 291 engage the ground shield and resiliently deform to accommodate any dimensional variation. The tines 291 also having a wiping action on the ground shield 231 as mating occurs, thereby ensuring that a positive electrical connection will be made between the ground shield 231 and the ground shield 289

As is best shown in FIG. 18, header 272 has a similar unique printed circuit board footprint as the previous embodiments. The circuit board mounting face 276 of header 272 has recessed areas 294 on either side of the elongated circuit board contact area 296. By providing the recessed areas 294, other components can be provided on the circuit board in areas that were previously occupied by the header. Ribs 298 are provided proximate the ends of contact area 296. The ribs 298 provide stability to the header 272 and help prevent it form rotating to either side, which could result in damage to the electrical connection between the header and the printed circuit board and could also damage other components on the circuit board.

Figure 20:
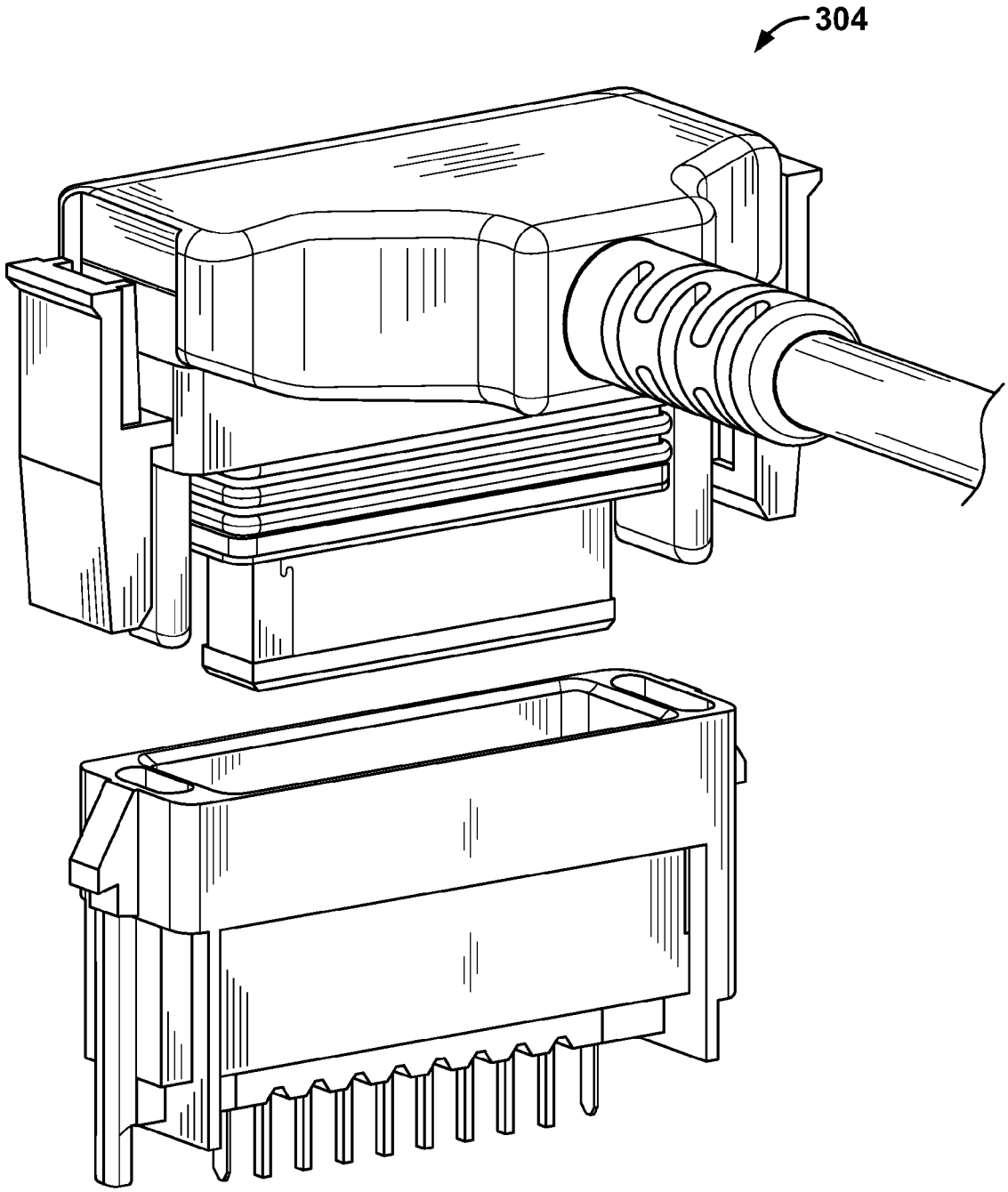
FIG. 20 is a perspective view of a right angle sealed connector assemblies prior to mating with the header shown in FIG. 18.
Figure 21:
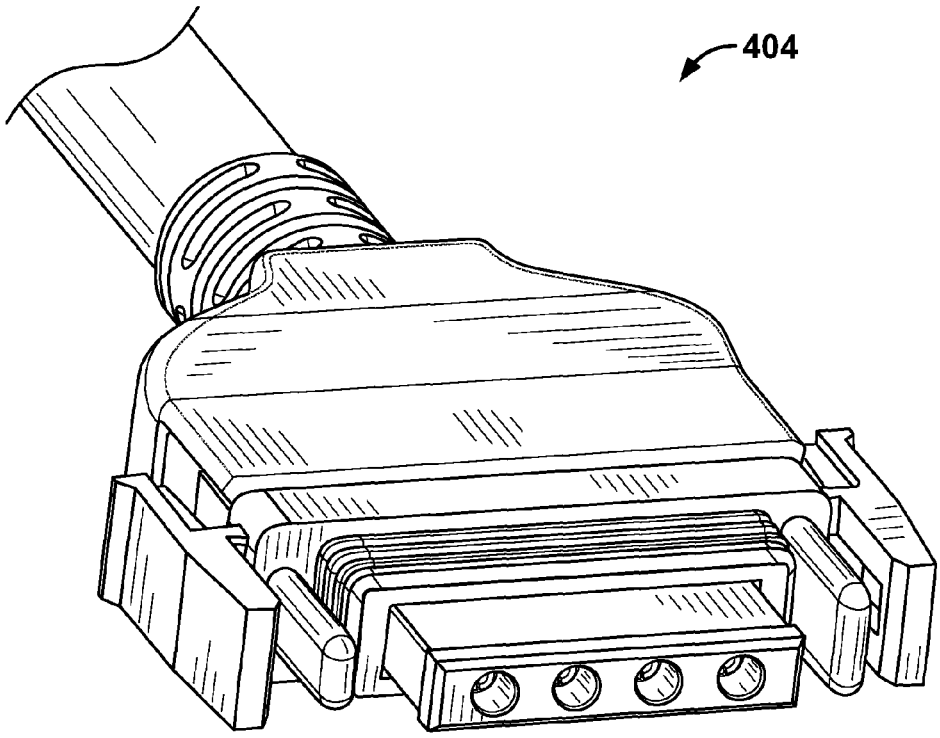
FIG. 21 is a perspective view of a fourth alternate sealed power connector assembly with shielding provided thereon.
Figure 22:
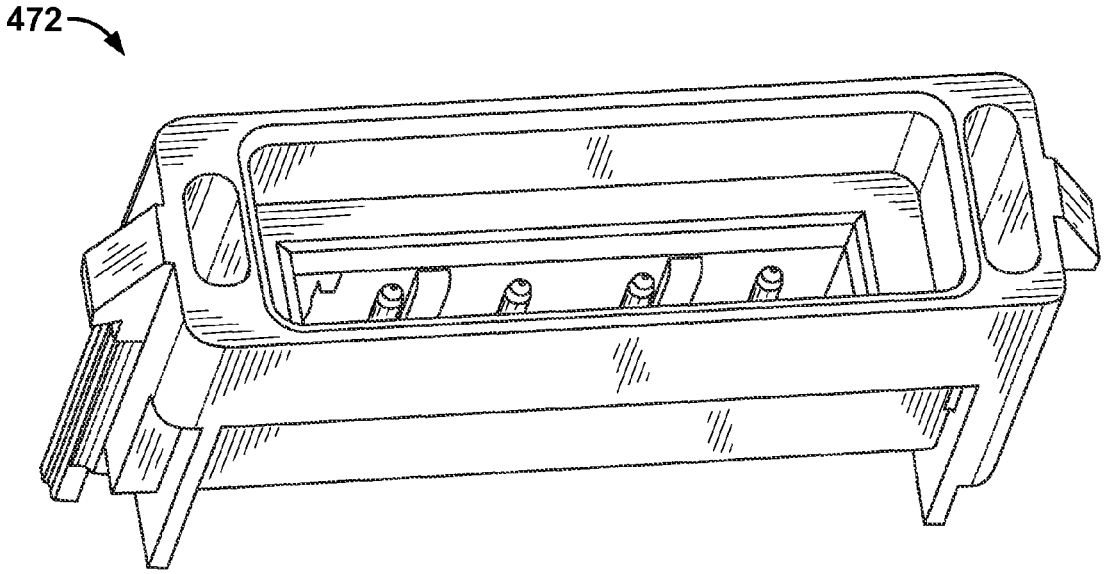
FIG. 22 is a front perspective view of a header that can be mated to the sealed power connector assembly of FIG. 21.
Figure 23:
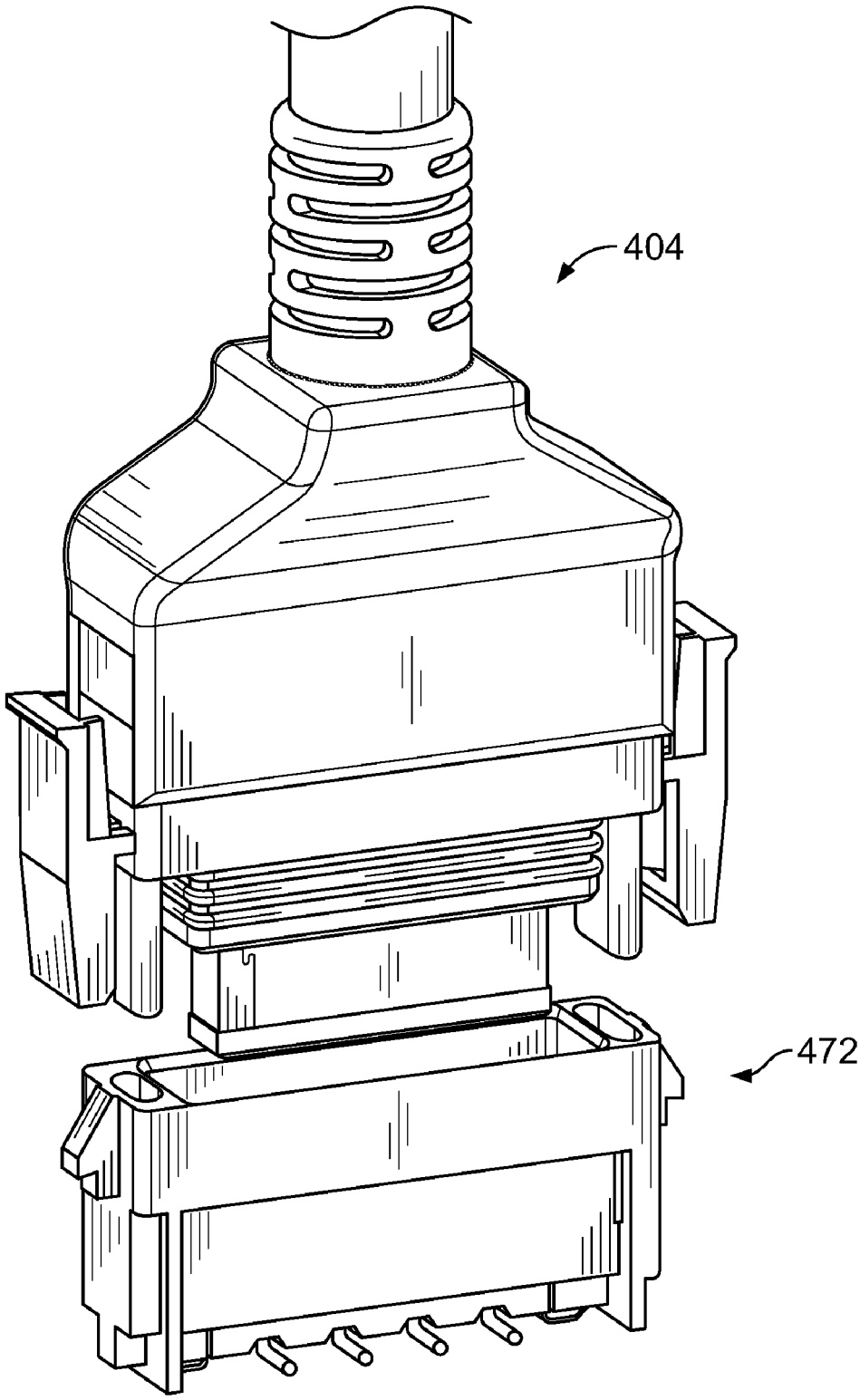
FIG. 23 is a perspective view of the sealed power connector assembly of FIG. 21 prior to mating with the surface mount header of FIG. 22.

FIG. 20 shows a connector similar to that of FIGS. 16 through 18, except that the connector assembly 304 has a right angle configuration. FIGS. 21 through 23 are also similar to FIGS. 16 through 18, except that header is surface mounted and the contacts provided in the connector assembly 404 and header 472 are power contacts rather than signal contacts It is worth noting that in any of the embodiments shown, with minor modifications and without departing from the scope of the invention, the contact and be used for signal, power or a combination of the two.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A sealed ribbon cable assembly comprising:

a contact receiving housing having a header mating surface and a ribbon cable mating surface the contact receiving housing having contacts which extend away from the header mating surface;

a ribbon cable positioned proximate the ribbon cable mating surface, the ribbon cable being terminated to the contacts to provide an electrical connection therebetween;

a molded housing which receives the contact receiving housing therein, the molded housing having a header mating end and a housing receiving end through which the contact receiving housing is secured;

a cover overmolded over a portion of the ribbon cable and a portion of the molded housing after the contact receiving housing has been secured therein, the cover being one continuous member which provides a sealed connection between the contact receiving housing, the molded housing and the ribbon cable to prevent contaminants from effecting the electrical connection between the contacts and the ribbon cable.

2. The ribbon cable assembly as recited in claim 1 wherein the overmolded cover has an integral housing sealing portion that covers the ribbon cable receiving end.

3. The ribbon cable assembly as recited in claim 2 wherein a header sealing portion is integral to and extends from the housing sealing portion in a direction toward the header mating end of the molded housing, the header sealing portion configured to cooperate with an opening in a mating header to provide a seal therebetween.

4. The ribbon cable assembly as recited in claim 3 wherein at least one rib is molded on the header sealing portion, the at least one rib accommodates manufacturing tolerances to insure that a seal will be provided between the header sealing portion and the opening in the mating header.

5. The ribbon cable assembly as recited in claim 2 wherein a cable sealing portion is integral to and extends from the housing sealing portion in a direction away from the header mating end, the cable sealing portion cooperates with the ribbon cable to form a seal around the ribbon cable and to provide strain relief, providing additional protection to the ribbon cable.

6. The ribbon cable assembly as recited in claim 1 wherein the overmolded cover is made from thermoplastic having the appropriate strength and resilient characteristics.

7. The ribbon cable assembly as recited in claim 1 wherein latch arms extend from the molded housing through the overmolded cover, the latch arms cooperate with a mating header to maintain the ribbon cable assembly and the mating header in a mated position.

8. The ribbon cable assembly as recited in claim 1 wherein keying projections extend from the molded housing, the keying projections are configured to prevent the ribbon cable assembly from being improperly mated to another connector.

9. The ribbon cable assembly as recited in claim 1 wherein a ground shield is provided proximate the header mating end of the housing.

10. A sealed connector system comprising:

a sealed cable assembly comprising:

a molded housing, a cable receiving housing and a cable terminated to the cable receiving housing;

the cable receiving housing having a header mating surface and a cable mating surface that cooperates with the cable;

the molded housing, which receives the contact receiving housing therein, having a header mating end and a housing receiving end through which the cable receiving housing is secured;

a cover overmolded over a portion of the ribbon cable and a portion of the molded housing after the cable receiving housing has been secured therein, the cover being one continuous member which provides a sealed connection between the cable receiving housing, the molded housing and the ribbon cable to prevent contaminants from entering the cable assembly;

a printed circuit board header assembly mated to the cable assembly, the header assembly having recesses provided proximate a circuit board mounting surface, the recesses being configured to provide additional space on a circuit board on which the header assembly is mounted.

11. The sealed connector system as recited in claim 10 wherein the overmolded cover has an integral housing sealing portion that covers the cable receiving end.

12. The sealed connector system as recited in claim 11 wherein a header sealing portion of the cover is integral to and extends from the housing sealing portion in a direction toward the header mating end of the molded housing, the header sealing portion cooperates with an opening in the header assembly to provide a seal therebetween.

13. The sealed connector system as recited in claim 12 wherein at least one rib is molded on the header sealing portion, the at least one rib accommodates manufacturing tolerances to insure that a seal will be provided between the header sealing portion and the opening in the mating header assembly.

14. The sealed connector system as recited in claim 11 wherein a header sealing member extends from proximate the housing sealing portion in a direction toward the header mating end of the cable connector, the header sealing member cooperates with an opening in the header assembly to provide a seal therebetween.

15. The sealed connector system as recited in claim 14 wherein at least one rib is provided on the header sealing member, the at least one rib accommodates manufacturing tolerances to insure that a seal will be provided between the header sealing portion and the opening in the mating header assembly.

16. The sealed connector system as recited in claim 11 wherein a cable sealing portion is integral to and extends from the housing sealing portion in a direction away from the header mating end of the cable connector, the cable sealing portion cooperates with the cable to form a seal around the cable and to provide strain relief, providing additional protection to the cable.

17. The sealed connector system as recited in claim 10 wherein the overmolded cover is made from thermoplastic having the appropriate strength and resilient characteristics.

18. The sealed connector system as recited in claim 10 wherein latch arms extend from the cable receiving housing, the latch arms cooperate with latching projections of the header assembly to maintain the cable assembly and the header assembly in a mated position.

19. The sealed connector system as recited in claim 10 wherein keying projections extend from the cable receiving housing, the keying projections are configured to cooperate with keying openings to insure that only appropriate respective cable assemblies and header assemblies are mated together.

20. The sealed connector system as recited in claim 10 wherein a cable housing ground shield is provided proximate the header mating end and a header assembly ground shield is provided in a cable housing receiving opening of the header assembly, whereby the cable housing ground shield and the header assembly ground shield are placed in electrical engagement with each other.

21. The sealed connector system as recited in claim 10 wherein the header assembly ground shield has resilient tines that project into the cable receiving opening, whereby the resilient tines resiliently engage the cable housing ground shield to provide a positive electrical connection therebetween.

* * * * *